US007025210B2

(12) United States Patent
Mooney

(10) Patent No.: US 7,025,210 B2
(45) Date of Patent: Apr. 11, 2006

(54) METHOD AND APPARATUS FOR ATTENUATING SOUND FROM VIBRATORY SCREENING MACHINES

(75) Inventor: James A. Mooney, Tonawanda, NY (US)

(73) Assignee: Derrick Manufacturing Corporation, Buffalo, NY (US)

( * ) Notice: Subject to any disclaimer, the term of this patent is extended or adjusted under 35 U.S.C. 154(b) by 210 days.

(21) Appl. No.: 10/418,001

(22) Filed: Apr. 17, 2003

(65) Prior Publication Data

US 2004/0206672 A1 Oct. 21, 2004

(51) Int. Cl.
*B07B 1/44* (2006.01)

(52) U.S. Cl. ..... 209/660; 209/674; 209/309; 209/364; 209/366.5; 209/367

(58) Field of Classification Search ..... 209/660, 209/674, 309–361, 364–367
See application file for complete search history.

(56) References Cited

FOREIGN PATENT DOCUMENTS

JP 6-221083 * 8/1994
JP 406221083 A * 8/1994

* cited by examiner

*Primary Examiner*—Donald P. Walsh
*Assistant Examiner*—Jonathan R Miller
(74) *Attorney, Agent, or Firm*—Simpson & Simpson, PLLC

(57) ABSTRACT

A method of attenuating the sound emanating from a bank of a plurality of vibrating screens of a plurality of vibrating screening machines including the steps of providing a master pulse of known phase and frequency, comparing the phase and frequency of a plurality of vibrating screens with the known phase and frequency of said master pulse, and adjusting the phase and frequency of said bank of plurality of vibrating screens so that the waveforms produced thereby tend to cancel each other. An apparatus for implementing the method is also disclosed.

9 Claims, 21 Drawing Sheets

29/30
R301
332 Ohm
1 / 2 Wat
D301
D302
D303
D304
D305
D306
D307
D308
D309
D310
D311
D312
D313
D314
D315
D316
IC301
4 Line
To
16 Line
Decoder
74CT4514
+5V
0V
GND
Vcc
A0
A1
A2
A3
LE
E
Q0
Q1
Q2
Q3
Q4
Q5
Q6
Q7
Q8
Q9
Q10
Q11
Q12
Q13
Q14
Q15
.047
25
AA
BB
CC
DD
EE
X
Z
Y
Z
Z

METHOD AND APPARATUS FOR ATTENUATING SOUND FROM VIBRATORY SCREENING MACHINES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to a method and apparatus for attenuating the sound emanating from a bank of a plurality of vibratory screening machines which are operating simultaneously.

By way of background, vibratory screening machines are used for the purpose of separating particulate materials. Each machine usually has a plurality of vibrating screens mounted thereon. The material to be separated is passed along the vibrating screens, and the finer material passes through the screens whereas the coarser material runs off of the end of the screens. The screens generally vibrate at a frequency within a range of between about 14–60 Hz. If the screens are of a very fine mesh or while they have material covering them in the course of normal operation, they can essentially function as loud speakers. Due to slight variations in the speed of the motors which vibrate the screens, the frequency of the individual machines will vary from one to the other by a few percent. This gives rise to a changing phase relationship among the various machines which causes a cyclic "droning" where the sound becomes louder and softer as the machines go in and out of phase with each other. This cyclic droning, which occurs generally within a typical period of between about 10–20 seconds, is particularly annoying to operating personnel or nearby residents.

BRIEF SUMMARY OF THE INVENTION

It is one object of the present invention to provide a method wherein a plurality of vibratory screening machines operate in such a manner so that they are substantially out of phase to the extent that the sound emanating from each of the machines contributes toward canceling the sound emanating from the others with the result that the droning noise is attenuated.

Another object of the present invention is to provide apparatus and circuitry which will effect the driving of certain of a plurality of vibratory screening machines substantially out of phase with other of the machines to thereby attenuate the sound emanating from the plurality of screening machines. Other objects and attendant advantages of the present invention will readily be perceived hereafter.

The present invention relates to a method of attenuating the sound emanating from a bank of a plurality of vibrating screens of a plurality of vibratory screening machines operating simultaneously comprising the steps of determining the phase of each of the machines, and causing certain of said vibrating screens to operate sufficiently out of phase with other of said vibrating screens to attenuate the sound emanating from said bank of vibrating screens.

The present invention also relates to an apparatus for attenuating sound emanating from a bank of a plurality of vibrating screens of a plurality of vibratory screening machines operating simultaneously, comprising means for determining the phase of each of the machines, and, means for causing certain of said vibrating screens to operate sufficiently out of phase with other of said vibrating screens to attenuate the sound emanating from said bank of vibrating screens.

The various aspects of the present invention will be more fully understood when the following portions of the specification are read in conjunction with the accompanying drawings wherein:

DETAILED DESCRIPTION OF THE INVENTION

Figure 1:
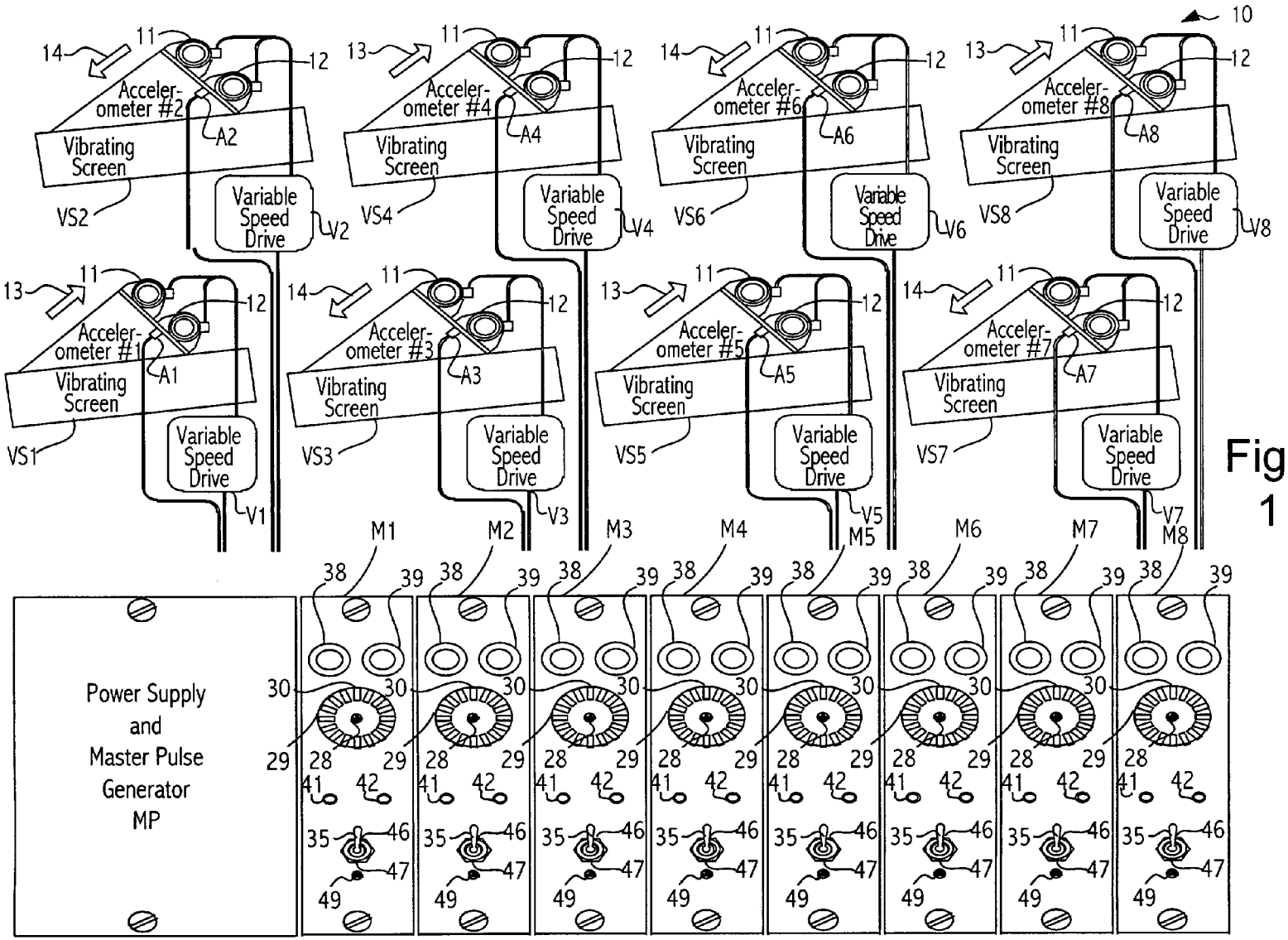
FIG. 1 is a block diagram showing a plurality of vibratory screening machines with one half operating out of phase with the other half and the general system for effecting this relationship.
Figure 2:
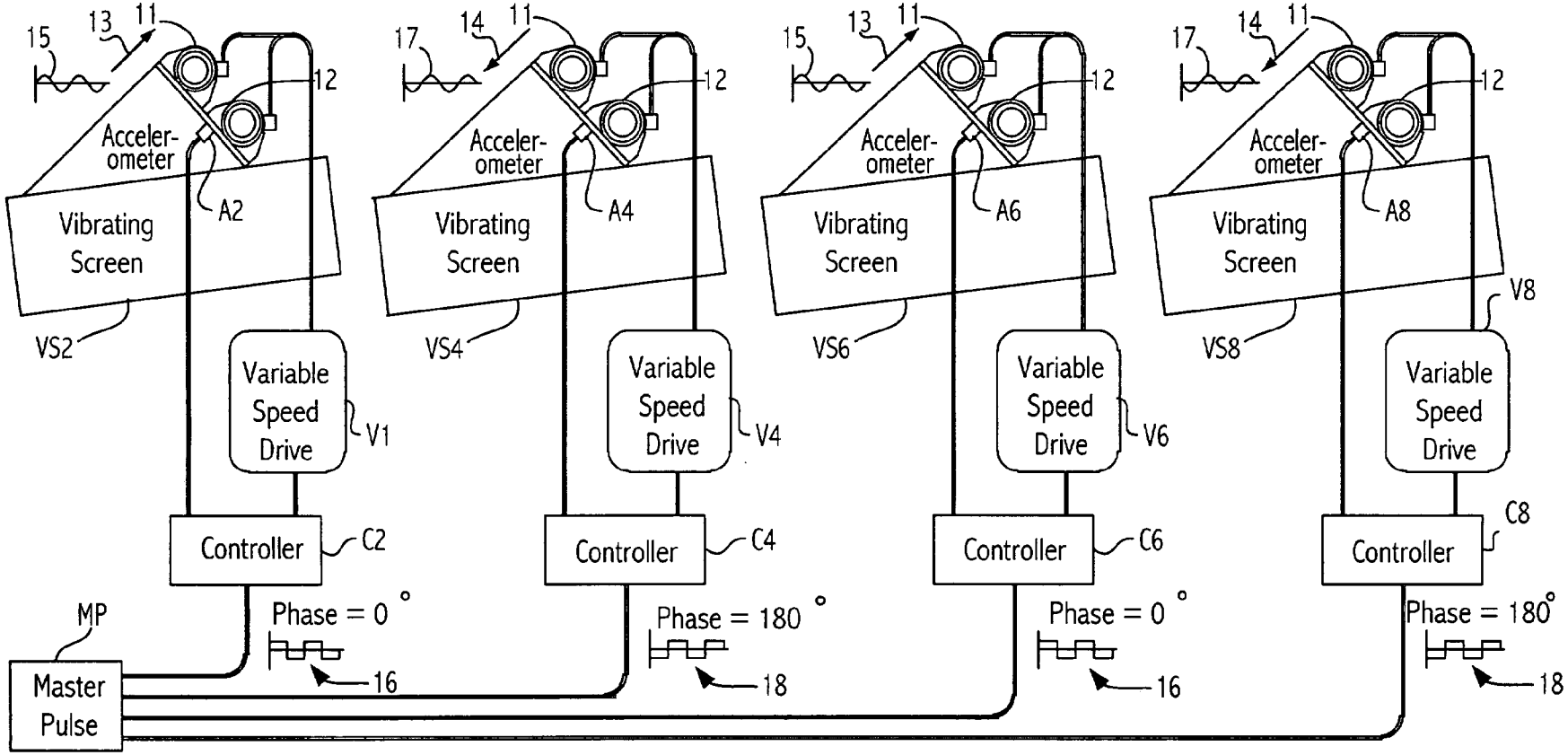
FIG. 2 is an enlarged modified portion of FIG. 1.

The overall setup of one embodiment of the present invention is shown in FIG. 1 and partially in FIG. 2. In FIG. 1 eight vibratory screens of vibratory screening machines are shown and are designated VS1 through VS8 with the caption "Vibrating Screen". Each device which is labeled "vibratory screen" may consist of one or more actual screens mounted on a vibratory frame of a vibratory screening machine. The vibratory screening machines with their vibrating screens are usually set up in the field in close side-by-side relationship. Machines of this general type are shown in U.S. Pat. Nos. 4,882,054 and 5,332,101, which are incorporated herein by reference. As is well understood in the art, the screens of the vibratory screening machines are driven by one or more vibratory motors 11 and 12 associated with each machine. While two motors are shown for each vibrating screen, there are certain screens which are driven by only one motor. When two motors are being used on each screen, even though each motor may normally operate slightly out of phase with the other motor, the fact that they are operating together on a vibrating screen associated with a specific machine which will cause the two motors to operate in a constant phase relationship. Thus, insofar as the present arrangement is concerned, the two motors of each vibrating screen will operate as a single motor.

Figure 3:
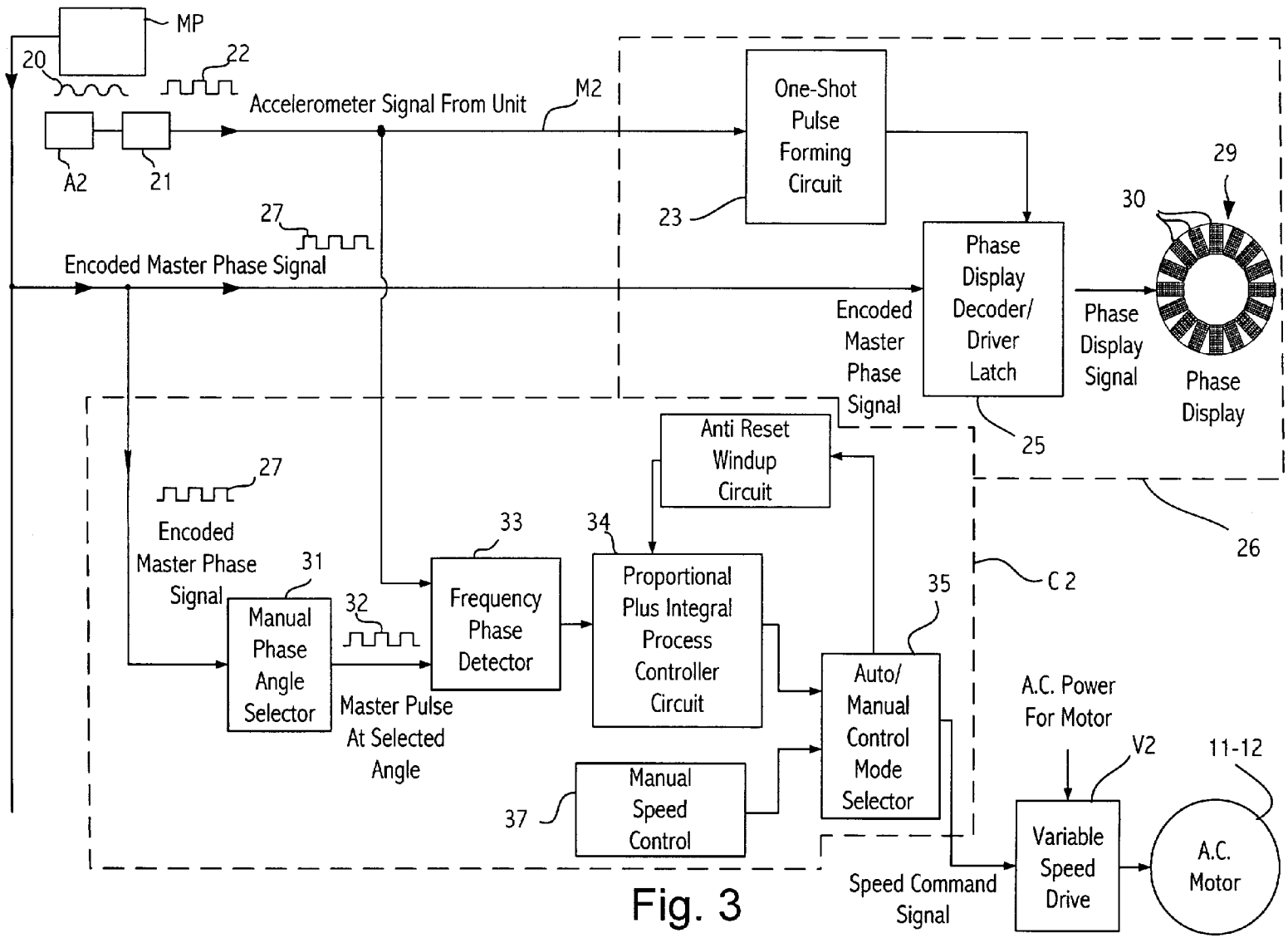
FIG. 3 is an electrical block diagram showing the control circuit associated with each vibratory screening machine; and, FIGS. 4A, 4B, 4C, 5A, 5B, 6A, 6B, 6C, 6D, 6E, 6F, 7, 8A, 8B, 9A, 9B, 9C, 9D and 10 comprise an electrical schematic diagram equivalent to the circuit shown in block diagram in FIG. 3.
Figure 4A:
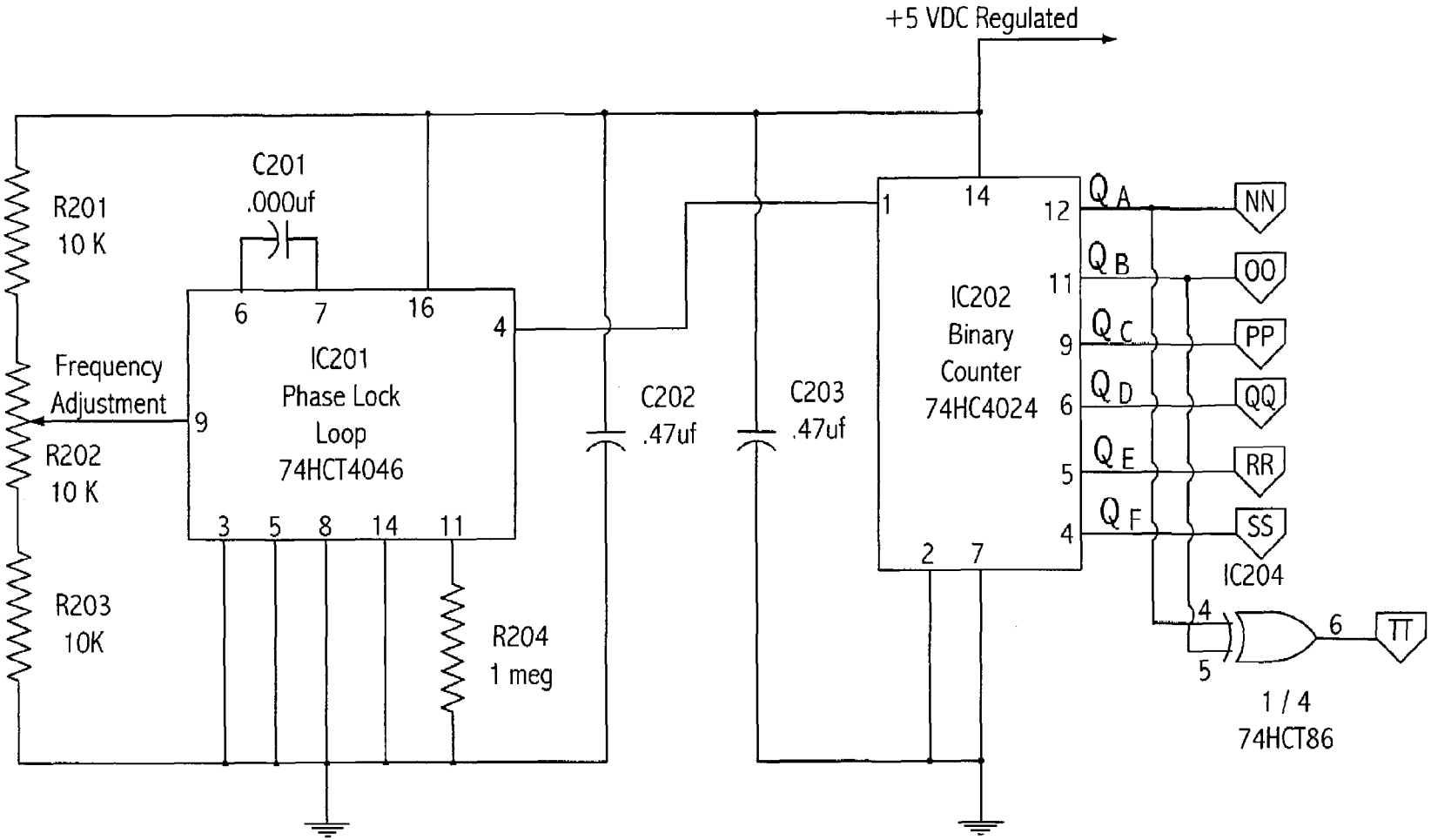
Figure 4B:
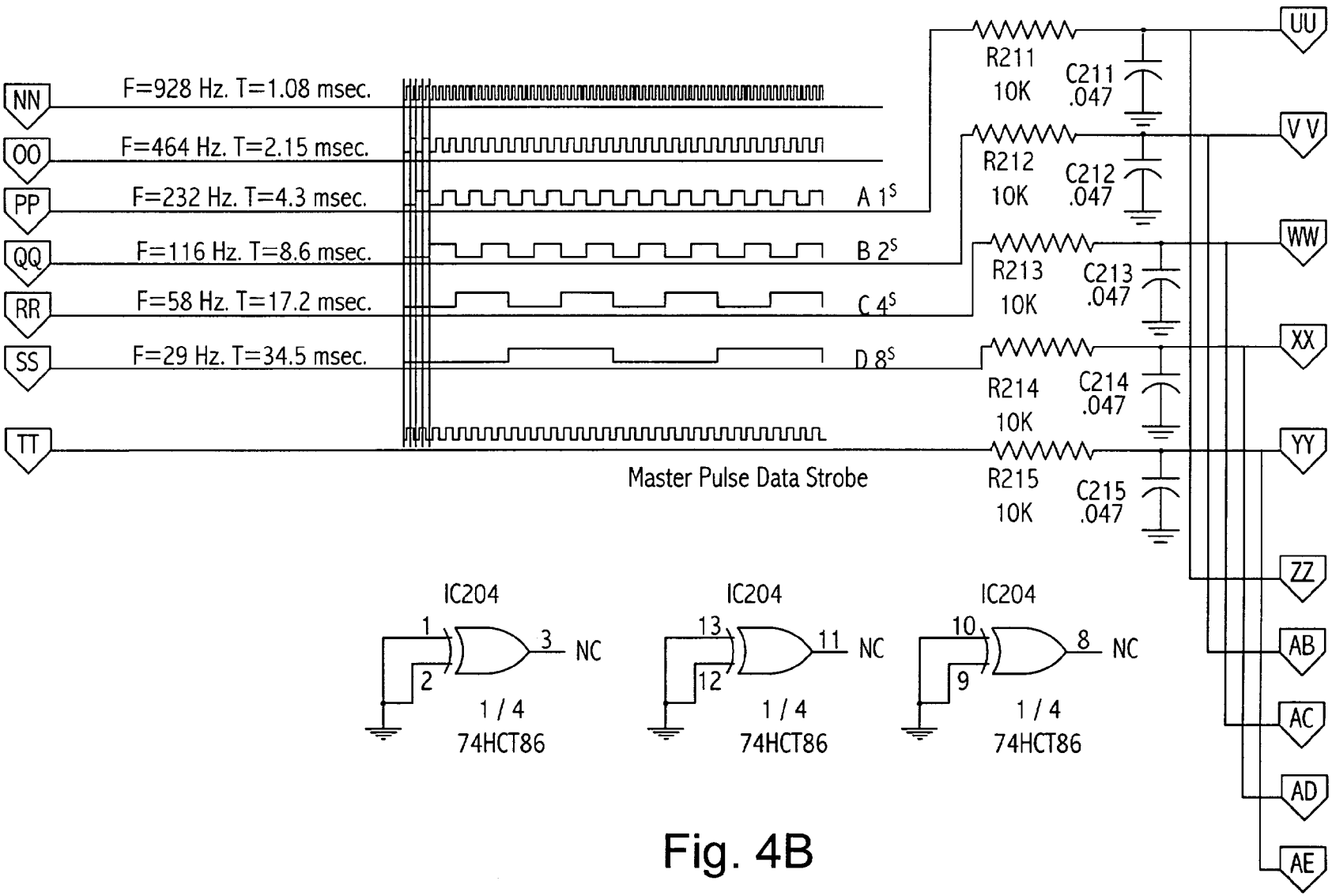
Figure 4C:
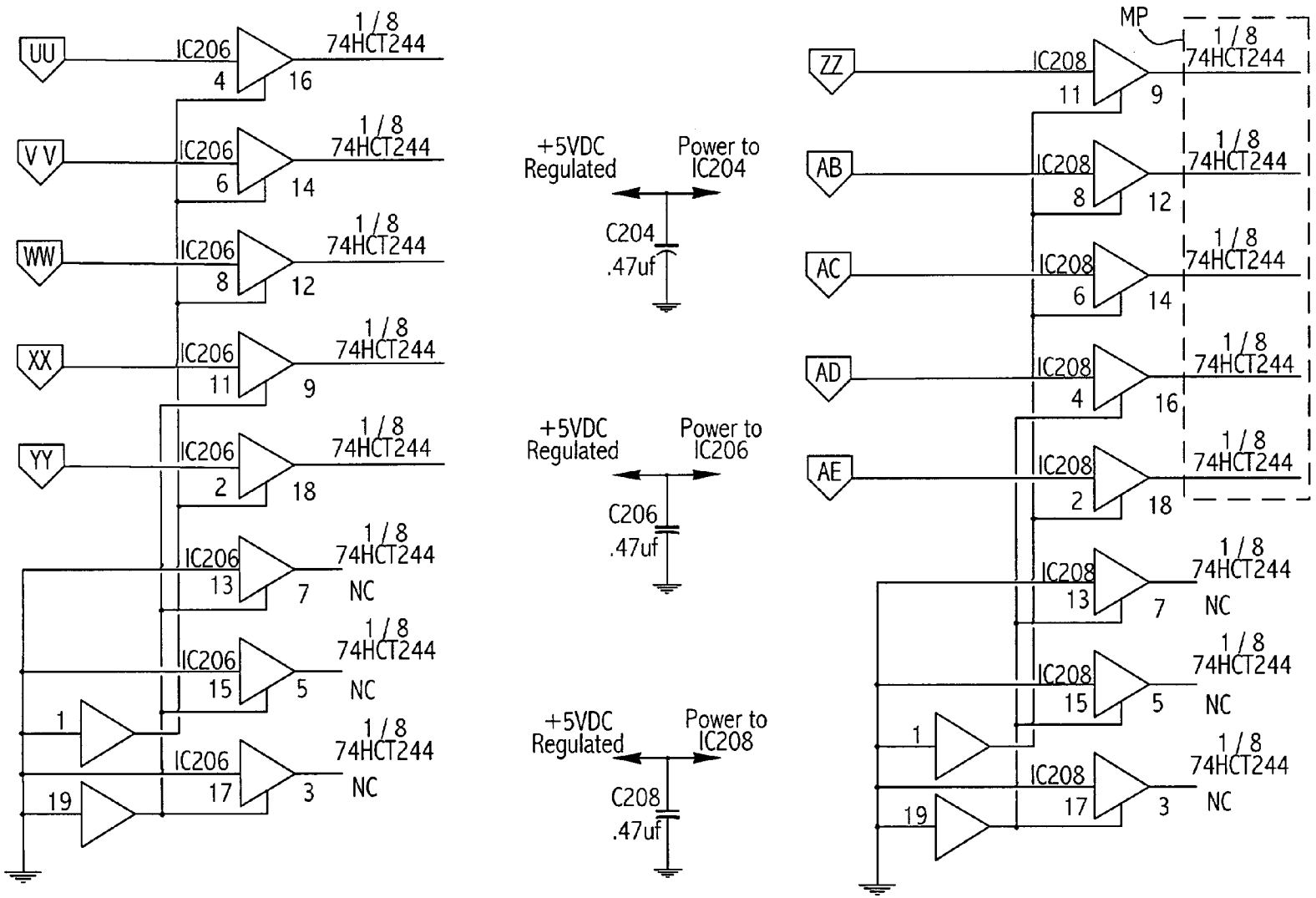
Figure 5A:
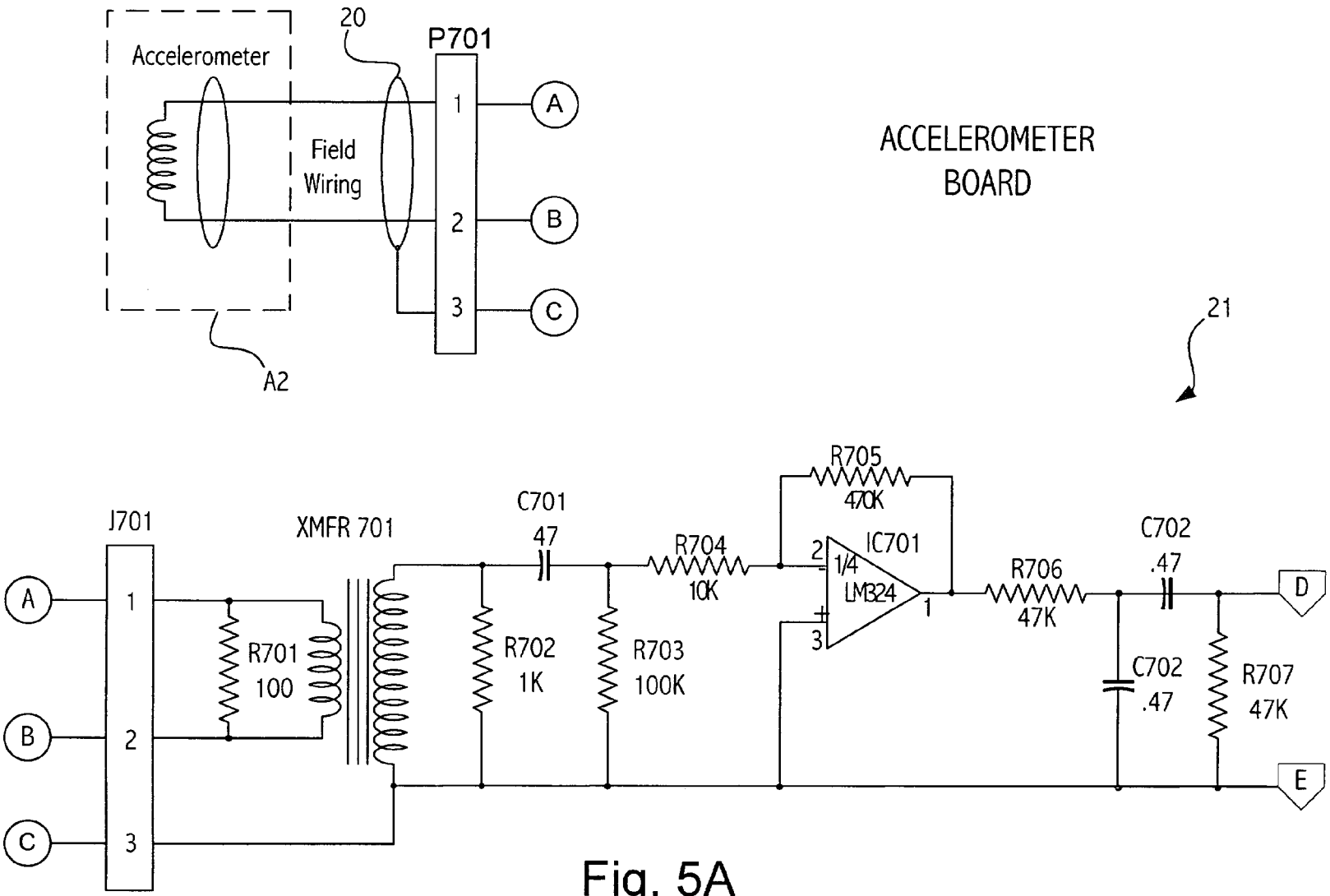
Figure 5B:
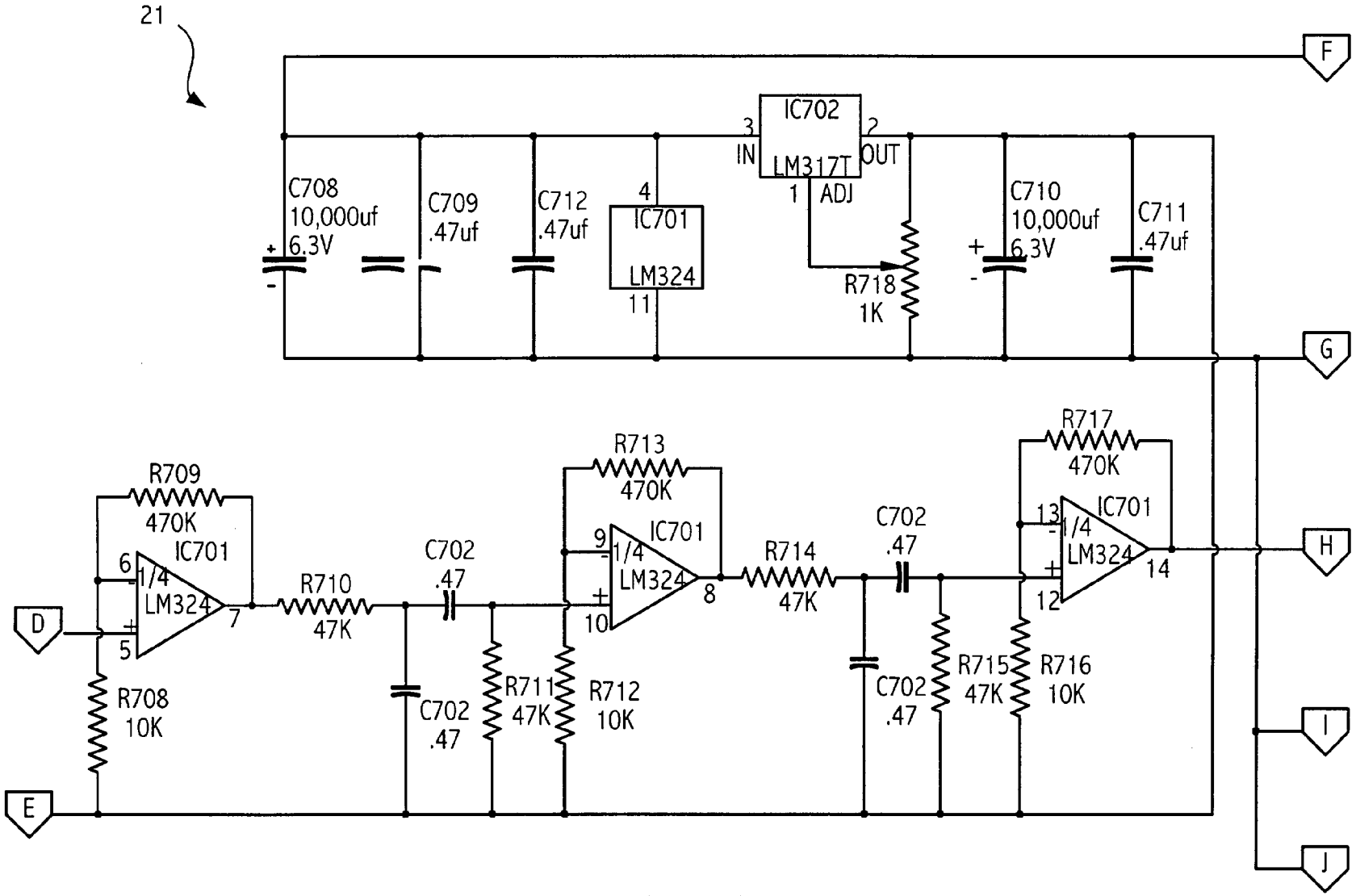
Figure 6A:
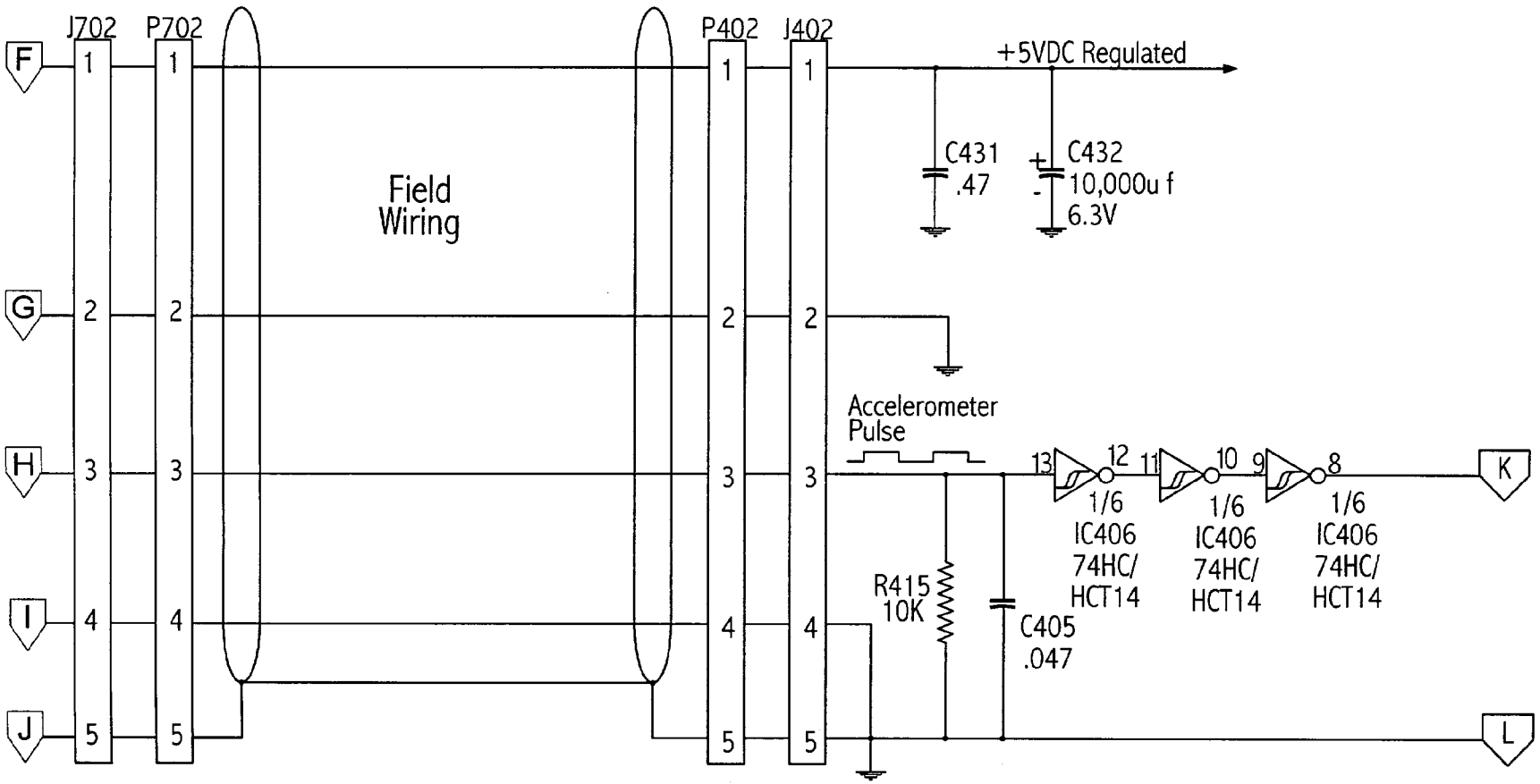
Figure 6B:
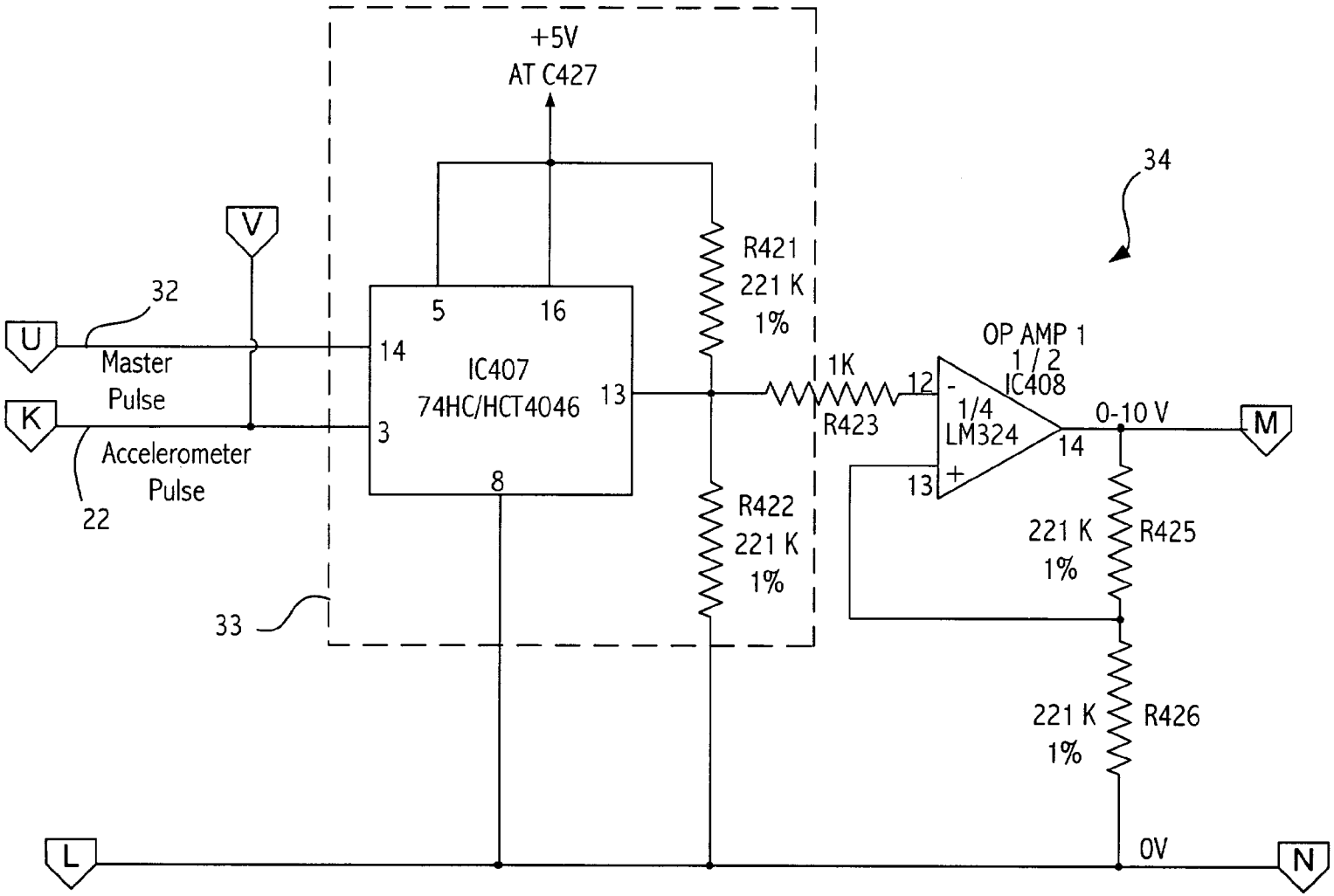
Figure 6C:
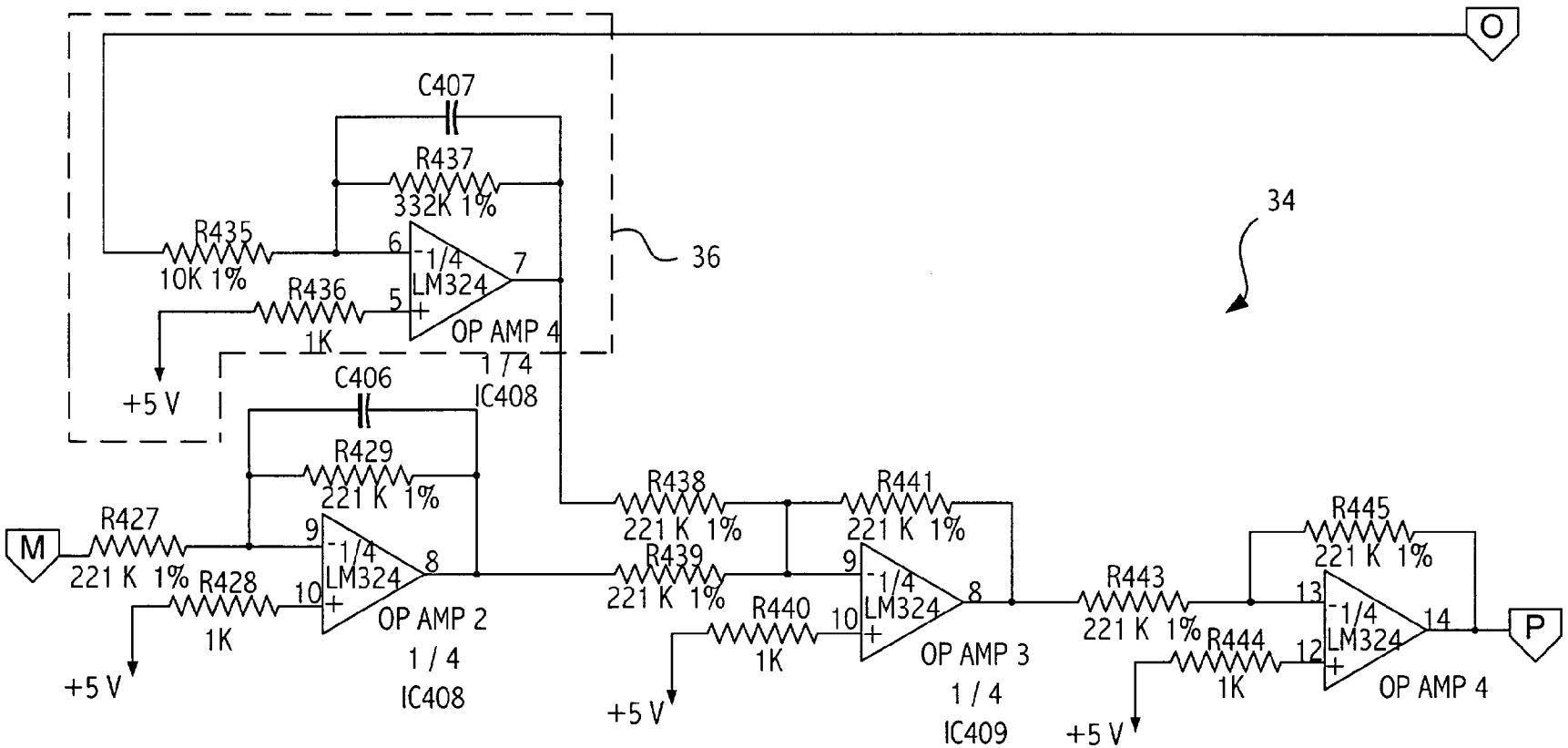
Figure 6D:
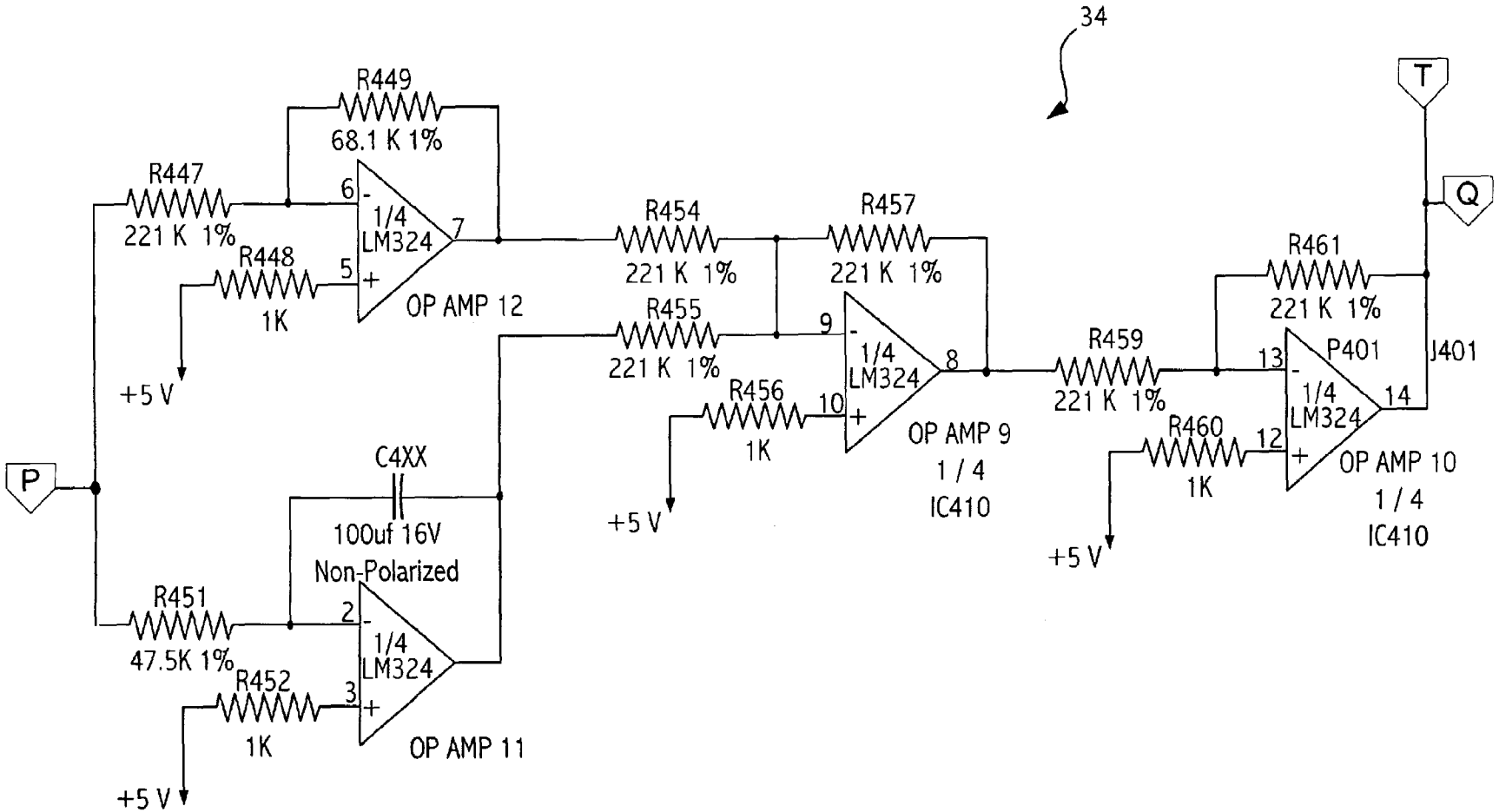
Figure 6E:
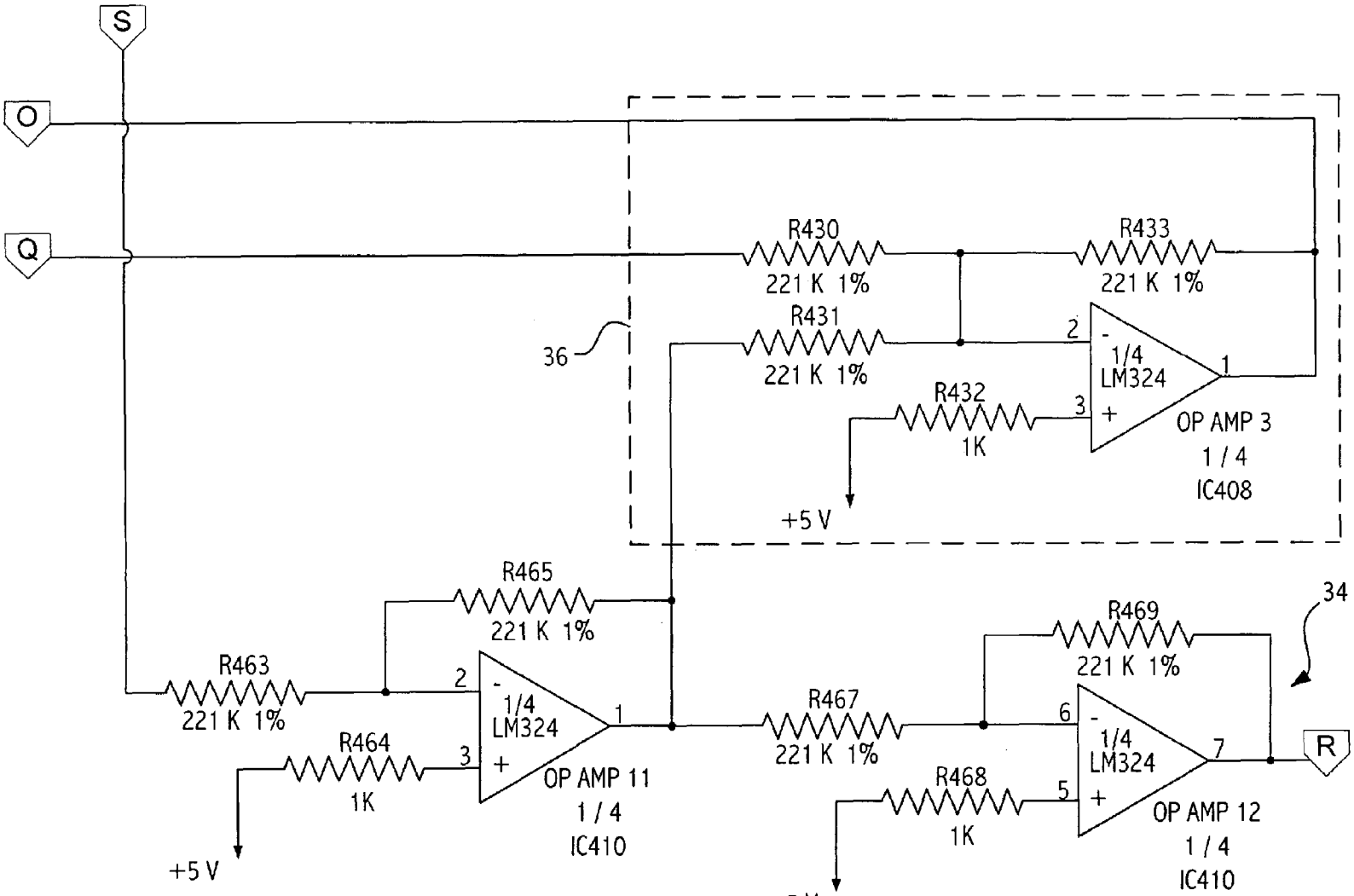
Figure 6F:
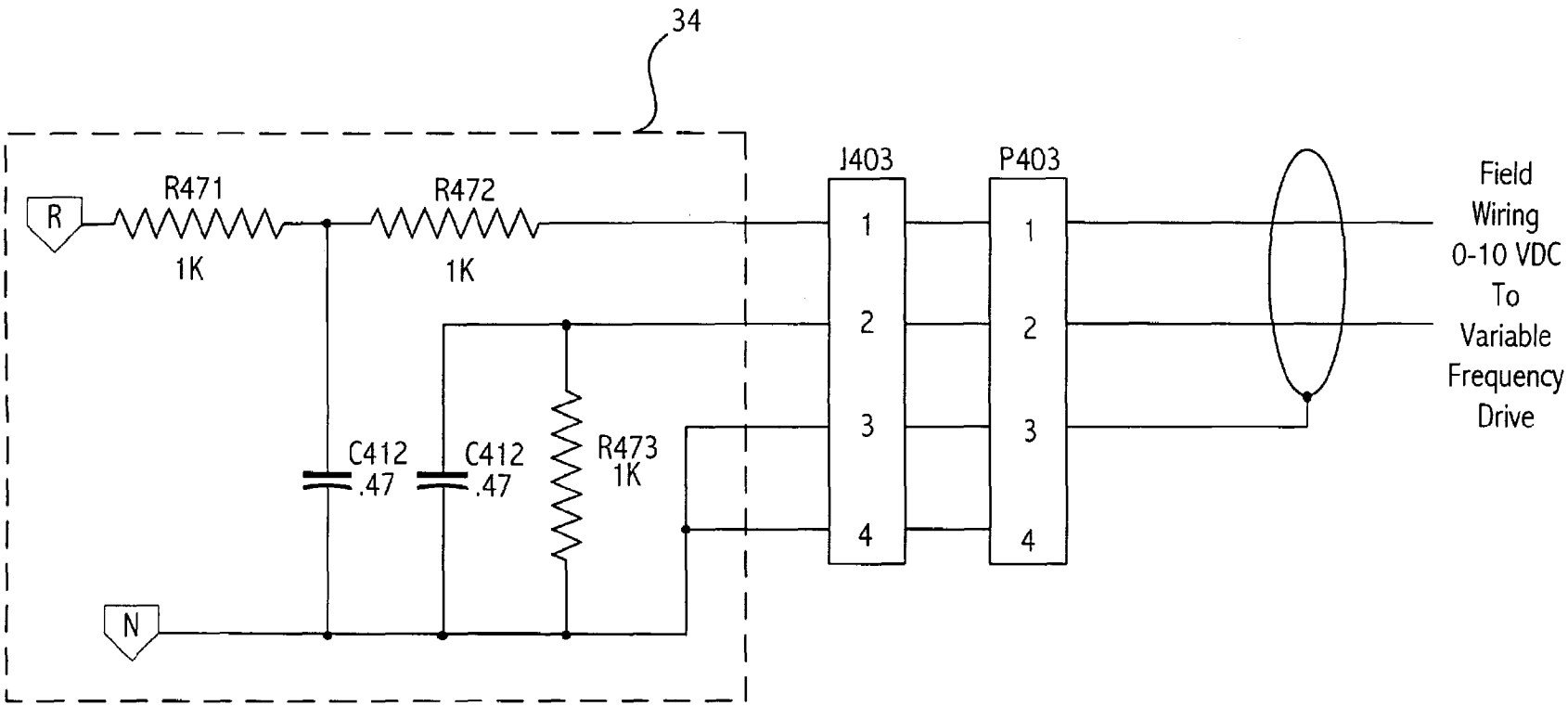
Figure 7:
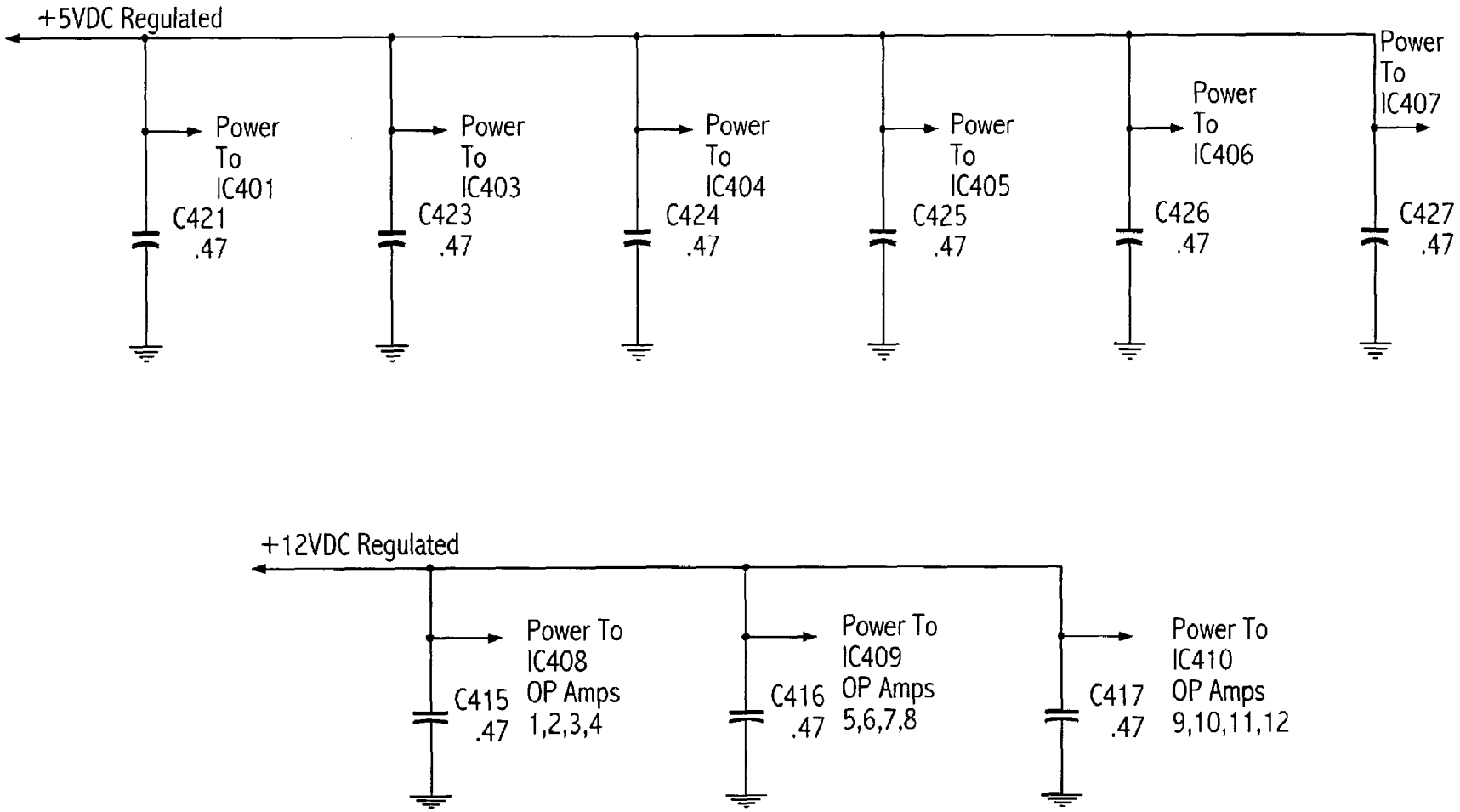
Figure 8A:
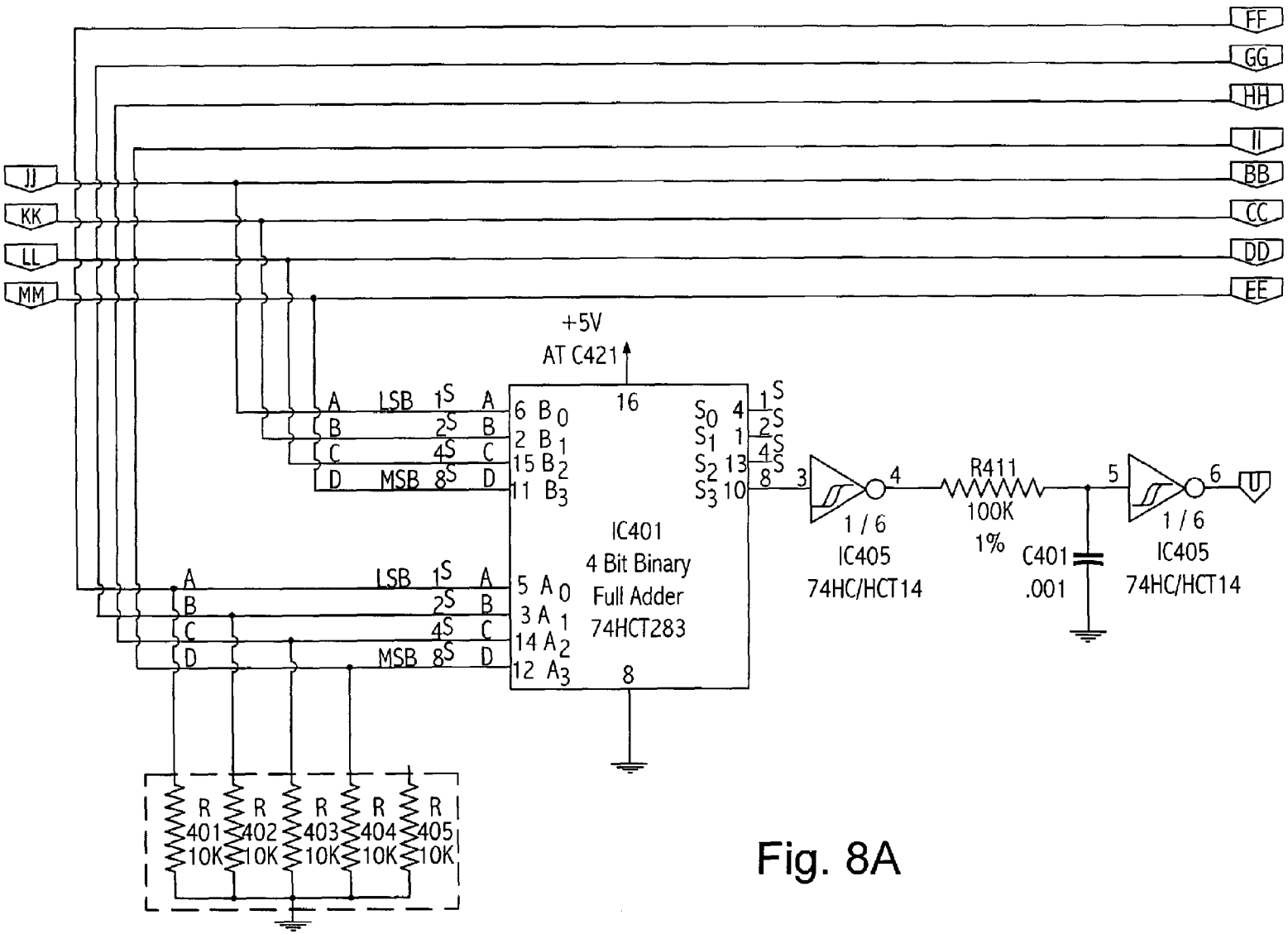
Figure 8B:
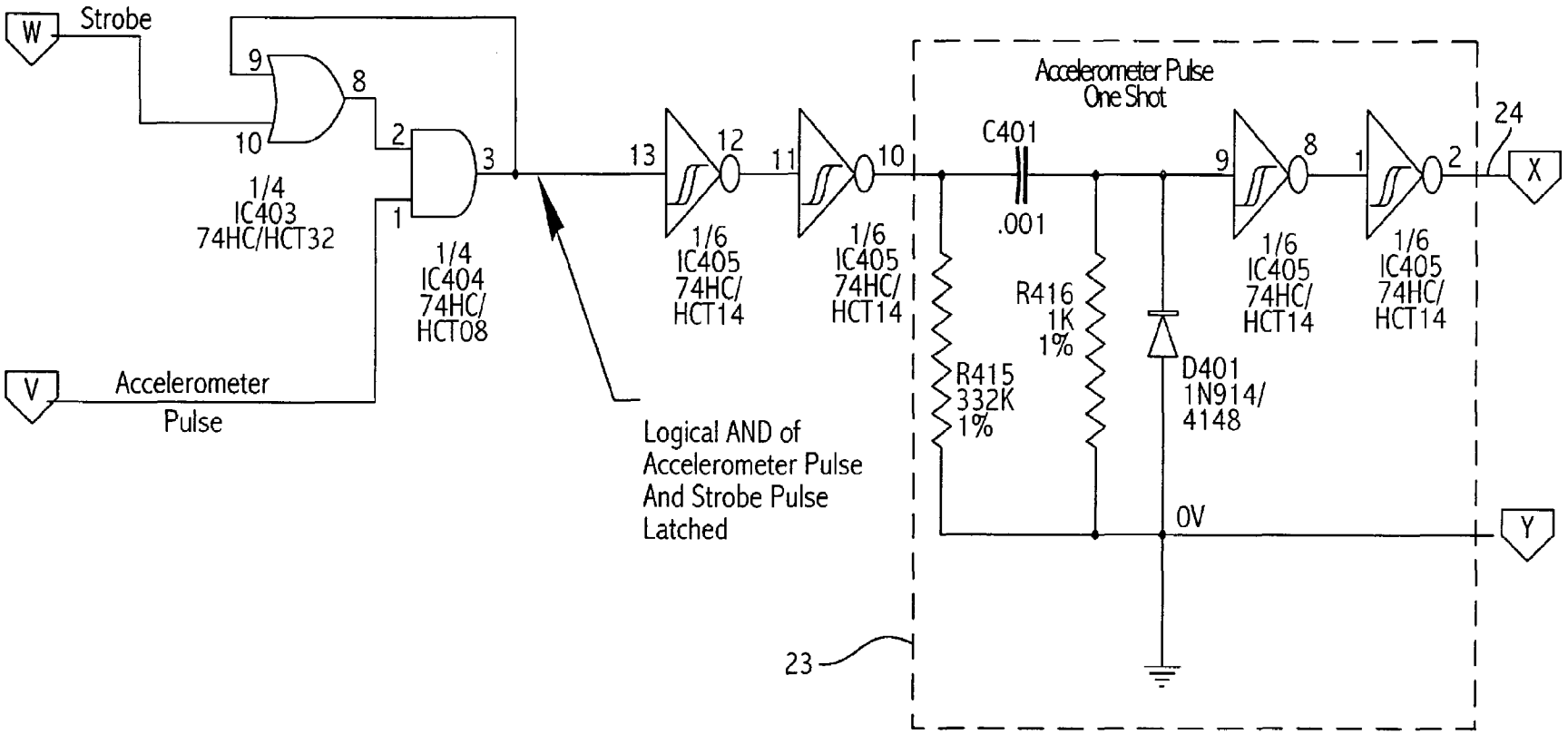
Figure 9A:
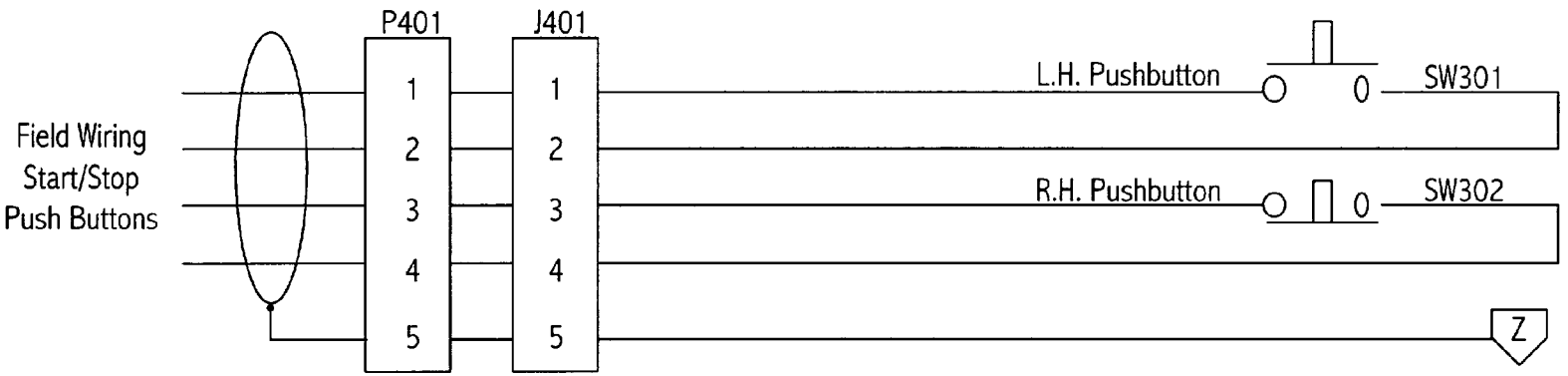
Figure 9B:
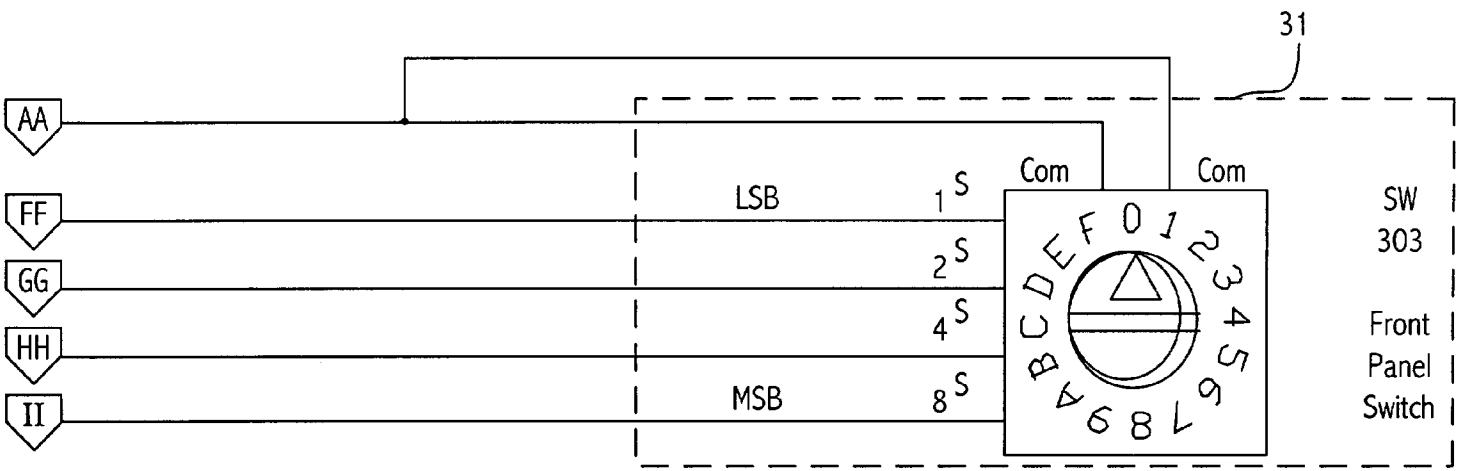
Figure 9C:
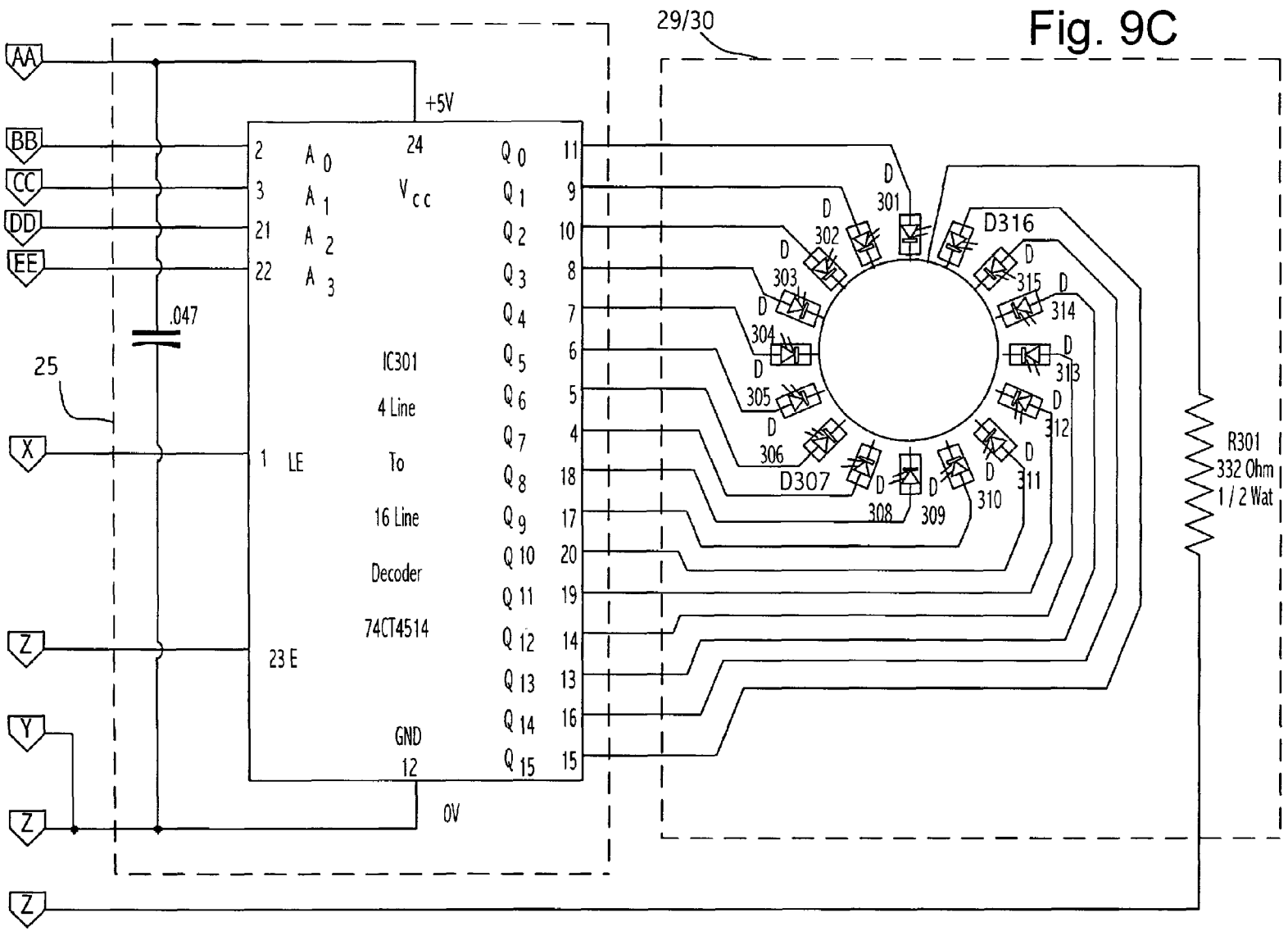
Figure 9D:
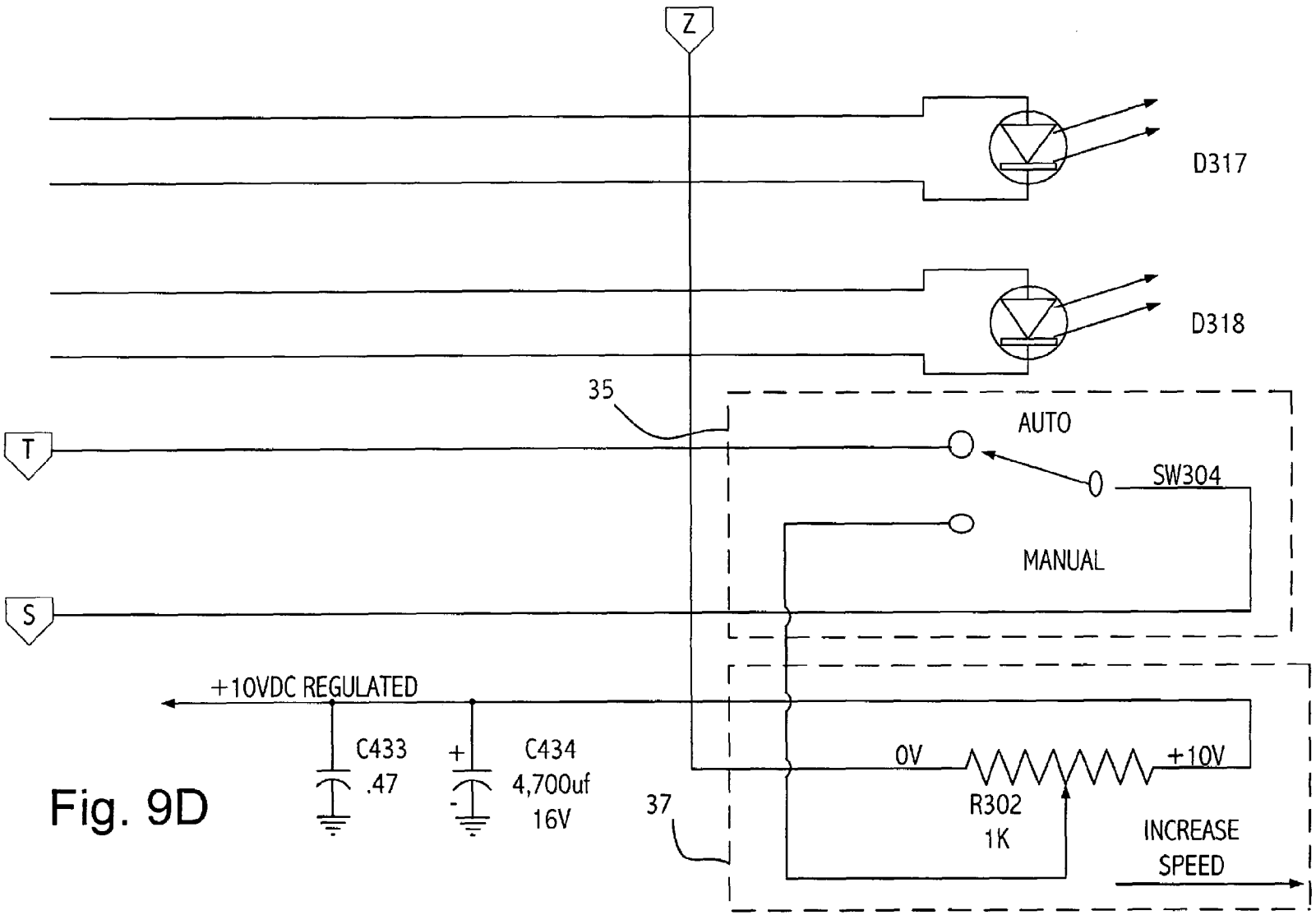
Figure 10:
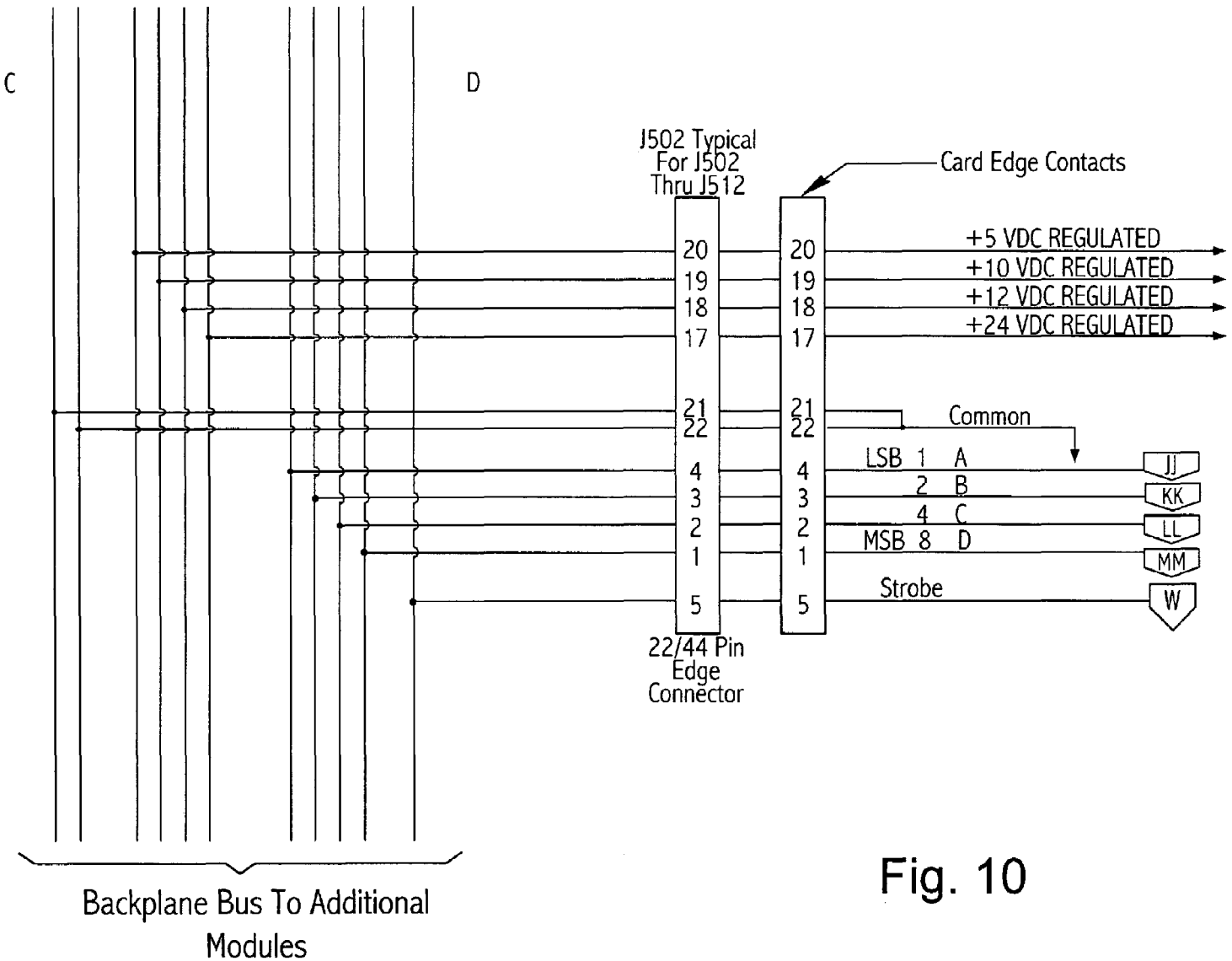

The illustrated embodiment in FIGS. 1–3 of the present invention causes one half of the vibrating screens VS1 through VS8 to operate out of phase with respect to the other half. Thus, one phase is designated by an arrow 13 which shows an associated vibrating screen operating in a certain phase and an arrow 14 shows an associated screen operating in an opposite phase. The phase 13 is depicted by the sine wave 15 of FIG. 2, and the phase 14, which is 180° out of phase with phase 13, is depicted by sine wave 17. Square waves 16, 18, 16, 18 associated with each of the vibrating screens VS2, VS4, VS6 AND VS8, respectively, of FIG. 2 represent waveforms generated by the associated controllers C2, C4, C6 and C8, respectively, which is described hereafter.

Broadly, each vibrating screen VS1, VS2, VS3, VS4, VS5, VS6, VS7 and VS8 has a controller C1, C2, C3, C4, C5, C6, C7 and C8, respectively, associated therewith. The components of controller C2 are shown within the dashed line box of FIG. 3, and the other controllers have like components. A controller such as C2 and phase display circuit 26 (FIG. 3) are located in each module M1, M2, etc. Controllers C2, C4, C6 and C8 are shown in FIG. 2. Modules M1, M2, M3, M4, M5, M6, M7 and M8 each contain a respective controller which is associated with each of the vibrating screens VS1, VS2, VS3, VS4, VS5, VS6, VS7 and VS8, respectively. Each controller, such as the illustrated controller C2, compares the phase of a specific screen with a master pulse which is generated by master pulse generator MP which is coupled to the controller associated with each vibrating screen, as set forth in detail hereafter.

Broadly, an accelerometer, such as A1 through A8, is placed on the vibrating screen of each vibratory screening machine. More specifically, the accelerometer is mounted on the vibratory frame of the vibrating screen of the vibratory screening machine, preferably on the portion which mounts the motors 11 and 12, as contrasted to being mounted on the stationary frame of the vibratory screening machine which supports the vibratory frame of the vibratory screening machine. These accelerometers are designated A1, A2, A3, A4, A5, A6, A7 and A8, which are associated with vibrating screens VS1, VS2, VS3, VS4, VS5, VS6, VS7 and VS8, respectively. The accelerometers are well known products of the piezoelectric type and are commercially available from PCB Piezotronics Company and designated by Model No. PCB 338B34. It will be appreciated that any suitable type of accelerometer may be used to provide the results discussed in detail hereafter.

Also associated with each vibrating screen VS1, VS2, VS3, VS4, VS5, VS6, VS7 and VS8 is a variable speed drive V1, V2, V3, V4, V5, V6, V7 and V8, respectively. The variable speed drive is utilized to change the speed of each motor set 11–12, to thereby vary the frequency of the vibrating screen driven thereby, as will be described in more detail hereafter. Each variable speed drive V1–V8 may be a product of the Baldor Company and identified by Model No. Baldor Series 15H Inverter Control, Cat. No. ID 15H415-W.

Basically, the apparatus of the present invention operates in the following manner, as described relative to the motor unit 11–12 associated with vibratory screen VS2 and its associated components such as A2, V2, C2, M2, etc. Each of the other motor sets 11–12 has a separate identical mode of operation and uses corresponding separate components, as shown in FIG. 3. The accelerometer A2 associated with vibrating screen VS2 produces a sine wave 20 (FIG. 3) and this sine wave is conducted to a signal conditioner 21 which converts the sine wave to a square wave 22. The signal conditioner is essentially an amplifier type of device which is commercially available. The conditioner 21 is mounted on the stationary non-vibrating frame of the machine in order to amplify the signal from the accelerometer for transmission over a relatively long cable, for example, a few hundred feet. It will be appreciated, if desired, that in certain instances the sine wave from the accelerometer may be transmitted directly to the one-shot pulse forming circuit 23. The square wave is conducted to a one shot pulse forming circuit 23 which produces single spaced pulses 24 of the same frequency as square waves 22 which are conducted to a phase display decoder/driver/latch 25 which is essentially a strobe type of device. Also conducted to display/decoder/driver/latch unit 25 is an encoded master phase signal of a square waveform 27. The display/decoder/driver/latch 25 functions as memory of the phase of the master pulse 27 at the time of the chosen reference point of the accelerometer pulse as indicated by pulse 24. The encoded master phase signal 27 is of a reference frequency and is produced by a conventional square wave generator which is in this instance an integrated circuit chip with peripheral components. The chip is of the 4046 type and the portion thereof which is used is the voltage controlled oscillator. Suitable resistors and capacitors are coupled to the chip to change the frequency to that which is desired in a well known manner. The display/decoder/driver/latch 25 shows the relationship between the pulses 24 produced by one shot pulse-forming circuit 23 and the pulse 27 produced by the master pulse generator MP. The output from unit 25 is a phase display signal which is produced on one of a plurality of LED's 30 of phase display 29 which shows the relative phase between the signal 24 and the master phase signal 27. The phase display 29 contains sixteen LED's 30 spaced 22½° apart. The LED 30 which is lit up, depicts the difference in phase between one shot signal 24 and the master phase signal 27.

The encoded master phase signal 27 is also output to a manual phase angle selector circuit 31 which selects the fundamental encoded master phase signal 27 and produces an output 32. In this respect, the manual phase angle selector circuit 31 manually functions to shift the encoded master phase pulse 27 a desired increment as indicated by the lighting of a desired LED on phase display 29. The phase angle selector circuit is basically a conventional phase angle shifting circuit which shifts the phase of the master phase signal 27 to a different phase shown at 32. The shifting to a specific LED 30 on phase display 29 represents the combined result of shifting the master pulse and the response of the phase of the vibrating screen VS2 to display the phase at which the screen is then operating relative to the master pulse 27. The shifting is effected by the manipulation of a screw-driver adjustment screw 28 (FIG. 1) on the module M2. For example, each screen operates at a nominal frequency of 29 Hz. However, as a practical matter, without the present system, the frequency of each screen may vary plus or minus a few percent. By the use of this system the frequency is locked or synchronized relative to the specific frequency of the master pulse and with a specific desired phase shift for each particular screen VS1, VS2, etc. Thus, as noted above, the manual phase angle selector 31 receives a version of the fundamental input 27 from the master pulse generator MP, and outputs waveform 32 to a frequency/phase detector 33 which is a comparator which compares the pulse 32 with the accelerometer signal 22 and produces an analog representation of error having a DC value. In the present instance, the output of 2.5 volts shows that there is no error between the two inputs 22 and 32, whereas an output between 2.5 volts and 5 volts will show a positive error and an output of between 0 and 2.5 volts will show a negative error. A positive error is when the waveform 22 from the accelerometer is leading the waveform 32 from the comparator and a negative error is the reverse. The analog output from the comparator 33, which is passed to a proportional plus integral process controller circuit 34, has a set point value, in this instance 2.5 volts, and the DC value produced by the comparator 33 is compared to this set point value to produce an output which shows the difference between the set point value and the input thereto from comparator 33. The proportional plus integral process controller circuit 34 is a well-known circuit utilizing an integrated circuit operational amplifier and peripheral components such as capacitors and resistors. The output from the controller circuit 34 is conducted to the auto/manual control mode selector 35 which is merely a toggle switch which determines whether the output from controller 34, namely, a speed command signal, is conducted to the variable speed drive V2 for the AC motor combination 11–12, or whether a speed command signal is fed to the variable speed drive from the manual speed control 37, which is a potentiometer. Thus, the output from the controller circuit 34 will cause the variable speed drive V2 to adjust the speed of the AC motor combination 11–12. The adjusted speed of the AC motor 11–12 will be read by the accelerometer A1, and the display on the LED phase display unit 29 will cause the appropriate LED 30 to be lit up to thereby show the variation of motor 11–12 of vibrating screen V2 relative to the encoded master phase signal 27 emanating from the master pulse generator MP. If it is desired to control the speed of the AC motor 11–12 manually, the mode selector switch 35 is placed in the manual position, and the manual speed control 37 can be used to provide a speed command signal to variable speed drive V1.

As noted above, a circuit such as described above relative to FIG. 3 is associated with each vibrating screen, and each circuit is separately housed in modules M1 through M8, inclusive. Therefore, the phase display of each vibrating screen will show the phase of that particular screen through the indication of which LED 30 is lit up. Therefore, by adjusting the phase of each motor unit 11–12 through the control circuit, the phases can be adjusted so that, for example, the phases of vibrating screens VS2, VS4, VS6 and VS8 are 180° out of phase with vibrating screens VS1, VS3, VS5 and VS7, as depicted by arrows 13 and 14 in FIG. 1.

It can thus be seen that the method of the present invention as specifically described above, namely, causing half of a plurality of vibratory screening machines to vibrate 180° out of phase with an equal number of vibratory screening machines will thus attenuate the sound emanating from the total number of vibratory screening machines.

While the above example has disclosed four vibratory screens operating 180° out of phase with four other vibrating screens, it will be appreciated that the out-of-phase relationship need not be as described but that the waveforms produced by the screens should bear the relationship that they effectively produce a canceling relationship to thereby attenuate undesirable noise, as described above. Thus, for example, three vibratory screens or multiples thereof can be caused to operate in a 120° out-of-phase relationship, or four screens, or multiples thereof can be caused to operate in a 90° out-of-phase relationship, or five vibrating screens could be caused to operate in a 72° out-of-phase relationship.

Although one having ordinary skill in the art can likely make the invention from mechanical and electrical block diagrams shown in FIGS. 1–4, such a person can certainly make the invention in view of the actual electrical circuit schematic shown in FIGS. 4A, 4B, 4C, 5A, 5B, 6A, 6B, 6C, 6D, 6E, 6F, 7, 8A, 8B, 9A, 9B, 9C, 9D and 10. This schematic, which shows actual component values, also shows connections between lines of different drawing sheets in baseball home plate symbols on respective drawings. For example, a line terminating in a home plate symbol labeled with letter "A" on one sheet is connected to a line terminating in a home plate symbol labeled with letter "A" on another sheet.

While a preferred embodiment of the present invention has been disclosed, it will be appreciated that it is not limited thereto but may be otherwise embodied within the scope of the following claims.

The invention claimed is:

1. A method of attenuating the sound emanating from a bank of a plurality of vibrating screens of a plurality of vibratory screening machines operating simultaneously comprising the steps of detecting, using an accelerometer, a motion of a respective vibrating screen for each of said machines to determine the phase of each of the machines, and causing certain of said vibrating screens to operate sufficiently out of phase with other of said vibrating screens to attenuate the sound emanating from said bank of vibrating screens.

2. A method as set forth in claim 1 wherein said plurality of machines comprise at least four machines, and wherein two of said machines operate substantially 180° out of phase with the other two machines.

3. A method as set forth in claim 1 wherein said step of determining the phase of each machine comprises the steps of providing a master pulse of known phase and frequency, and comparing the phase and frequency of each of said vibrating screens to said known phase and frequency of said master pulse.

4. A method as set forth in claim 3 wherein said step of causing certain of said vibrating screens to operate sufficiently out-of-phase with other of said vibrating screens includes the step of varying the speed of vibration of certain of said vibrating screens.

5. A method as set forth in claim 4 including the step of displaying the phase of each of said vibrating screens.

6. A method of attenuating the sound emanating from a bank of a plurality of vibrating screens of a plurality of vibrating screening machines comprising the steps of providing a master pulse of known phase and frequency, detecting, using an accelerometer, a motion of a respective vibrating screen for each of said machines to determine the phase of each of the machines, comparing the phase and frequency of the plurality of vibrating screens with said known phase and frequency of said master pulse, and adjusting the phase and frequency of said bank of plurality of vibrating screens so that the waveforms produced thereby tend to cancel each other.

7. A method as set forth in claim 6 wherein said step of comparing said phase and frequency of said master pulse with said phase and frequency of each vibrating screen results in producing a voltage output which is representative of the desired phase and the actual phase which is used to effect corrections of the phase relative to the master pulse.

8. An apparatus for attenuating sound emanating from a bank of a plurality of vibrating screens of a plurality of vibratory screening machines operating simultaneously, comprising:

an accelerator for detecting a motion of a respective vibrating screen for each of said machines to determine the phase of each of the machines; and, means for causing certain of said vibrating screens to operate sufficiently out of phase with other of said vibrating screens to attenuate the sound emanating from said bank of vibrating screens.

9. An apparatus for attenuating sound emanating from a bank of a plurality of vibrating screens of a plurality of vibrating screening machines, comprising:

means for providing a master pulse of known phase and frequency;

an accelerator for detecting a motion of a respective vibrating screen for each of said machines to determine the phase of each of the machines;

means for comparing the phase and frequency of the plurality of vibrating screens with said known phase and frequency of said master pulse; and, means for adjusting the phase and frequency of said bank of plurality of vibrating screens so that the waveforms produced thereby tend to cancel each other.

* * * * *